US010302387B2

(12) United States Patent
Doty et al.

(10) Patent No.: US 10,302,387 B2
(45) Date of Patent: May 28, 2019

(54) FIREARM STOCK WITH ADJUSTABLE COMB RISER

(71) Applicant: McMillan Fiberglass Stocks, Inc., Phoenix, AZ (US)

(72) Inventors: Heath Alan Doty, Webster Groves, MO (US); Melvin Joshua Leedle, Bridgeton, MO (US)

(73) Assignee: MCMILLAN FIBERGLASS STOCKS, INC., Phoenix, AZ (US)

( * ) Notice: Subject to any disclaimer, the term of this patent is extended or adjusted under 35 U.S.C. 154(b) by 0 days.

(21) Appl. No.: 15/936,565

(22) Filed: Mar. 27, 2018

(65) Prior Publication Data

US 2018/0335273 A1 Nov. 22, 2018

Related U.S. Application Data

(60) Provisional application No. 62/509,231, filed on May 22, 2017.

(51) Int. Cl.
*F41C 23/14* (2006.01)
*F41C 23/08* (2006.01)

(52) U.S. Cl.
CPC ..... *F41C 23/14* (2013.01); *F41C 23/08* (2013.01)

(58) Field of Classification Search
CPC ..... F41C 23/06; F41C 23/08; F41C 23/14; F41C 23/20
See application file for complete search history.

(56) References Cited

U.S. PATENT DOCUMENTS 2,669,051 A * 2/1954 Cline ..... F41C 23/14 42/71.01
2,787,855 A * 4/1957 Guymon ..... F41C 23/14 42/73
4,203,243 A * 5/1980 Hickman ..... F41C 23/14 42/112
4,203,244 A * 5/1980 Hickman ..... F41C 23/14 42/73
4,896,446 A * 1/1990 Gregory ..... F41C 23/14 42/72
5,392,553 A * 2/1995 Carey ..... F41C 23/14 42/73

(Continued)

FOREIGN PATENT DOCUMENTS

DE 202011051276 U1 * 12/2012 ..... F41C 23/08
EP 1688696 A1 * 8/2006 ..... F41C 23/14

*Primary Examiner* — Benjamin P Lee
(74) *Attorney, Agent, or Firm* — Bennet K. Langlotz; Langlotz Patent & Trademark Works, LLC

(57) ABSTRACT

A firearm stock with adjustable comb riser has an elongated stock body having a forend and an opposed butt portion having a rear face and an upper comb surface, a butt pad removably connected to the rear face, a cheek rest element having an elongated rest portion positioned above the upper comb surface of the stock, the cheek rest element having a rear panel connected to the rest portion, and at least a portion of the rear panel being captured between the rear face and the butt pad. The rest portion may be a downwardly open channel. The channel may receive at least a portion of the comb surface. The rest portion may include downwardly depending sidewalls. An upper portion of the rear panel may span between the sidewalls. The rear panel may be perpendicular to the rest portion.

20 Claims, 12 Drawing Sheets

(56) References Cited

U.S. PATENT DOCUMENTS

| | | | | | |
|---|---|---|---|---|---|
| 5,711,102 | A * | 1/1998 | Plaster | F41C 23/00 | 42/71.01 |
| 5,970,642 | A * | 10/1999 | Martin | F41C 23/14 | 42/73 |
| 7,104,002 | B2 * | 9/2006 | Rotundo | F41C 23/14 | 42/71.01 |
| 7,536,819 | B2 * | 5/2009 | Popikow | F41C 23/14 | 42/71.01 |
| 8,776,423 | B2 * | 7/2014 | Paquette | F41C 23/14 | 42/73 |
| D722,671 | S * | 2/2015 | Mayberry | D22/108 | |
| 9,074,839 | B2 * | 7/2015 | Warburton | F41C 23/14 | |
| 2006/0174532 | A1 * | 8/2006 | Popikow | F41C 23/14 | 42/73 |
| 2013/0174461 | A1 * | 7/2013 | Ballard | F41C 23/08 | 42/74 |
| 2014/0190055 | A1 * | 7/2014 | Warburton | F41C 23/14 | 42/71.01 |
| 2014/0250756 | A1 * | 9/2014 | Vesligaj | F41C 23/06 | 42/74 |
| 2014/0259848 | A1 * | 9/2014 | Chvala | F41C 23/14 | 42/73 |
| 2014/0283428 | A1 * | 9/2014 | Slater | F41C 23/14 | 42/71.01 |

* cited by examiner

FIREARM STOCK WITH ADJUSTABLE COMB RISER

FIELD OF THE INVENTION

The present invention relates to firearms, and more particularly to a firearm having an adjustable comb riser.

BACKGROUND OF THE INVENTION

The comb riser is a device on a rifle stock that supports the shooter's cheek at a height suitable for use with the sights. High sights such as telescopic sights require higher comb risers, and low sights such as iron sights require low comb risers. Different users' preferences and physiology also suggests the advantage of enabling different riser heights for any given configuration.

These devices vary significantly between firearms, and various adjustable comb risers are known. A traditional approach relies upon raising and lowering the entire comb riser. An alternative pivoting approach is also known. However, conventional approaches to adjustable comb risers require the use of additional fasteners solely for adjusting the height of the comb riser. These fasteners may protrude and lead to snagging or user injury. In addition, conventional approaches do not permit the comb riser to shift fore and aft on the rifle stock to account for adjustments to the butt stock that change the length of pull.

Therefore, a need exists for a new and improved firearm stock with adjustable comb riser that utilizes the fasteners for the recoil pad and can be shifted fore and aft on the rifle stock to account for adjustments to the butt stock that change the length of pull. In this regard, the various embodiments of the present invention substantially fulfill at least some of these needs. In this respect, the firearm stock with adjustable comb riser according to the present invention substantially departs from the conventional concepts and designs of the prior art, and in doing so provides an apparatus primarily developed for the purpose of utilizing the fasteners for the recoil pad and allowing the comb riser to be shifted fore and aft on the rifle stock to account for adjustments to the butt stock that change the length of pull.

SUMMARY OF THE INVENTION

The present invention provides an improved firearm stock with adjustable comb riser, and overcomes the above-mentioned disadvantages and drawbacks of the prior art. As such, the general purpose of the present invention, which will be described subsequently in greater detail, is to provide an improved firearm stock with adjustable comb riser that has all the advantages of the prior art mentioned above.

To attain this, the preferred embodiment of the present invention essentially comprises an elongated stock body having a forend and an opposed butt portion having a rear face and an upper comb surface, a butt pad removably connected to the rear face, a cheek rest element having an elongated rest portion positioned above the upper comb surface of the stock, the cheek rest element having a rear panel connected to the rest portion, and at least a portion of the rear panel being captured between the rear face and the butt pad. The rest portion may be a downwardly open channel. The channel may receive at least a portion of the comb surface. The rest portion may include downwardly depending sidewalls. An upper portion of the rear panel may span between the sidewalls. The rear panel may be perpendicular to the rest portion. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1A:
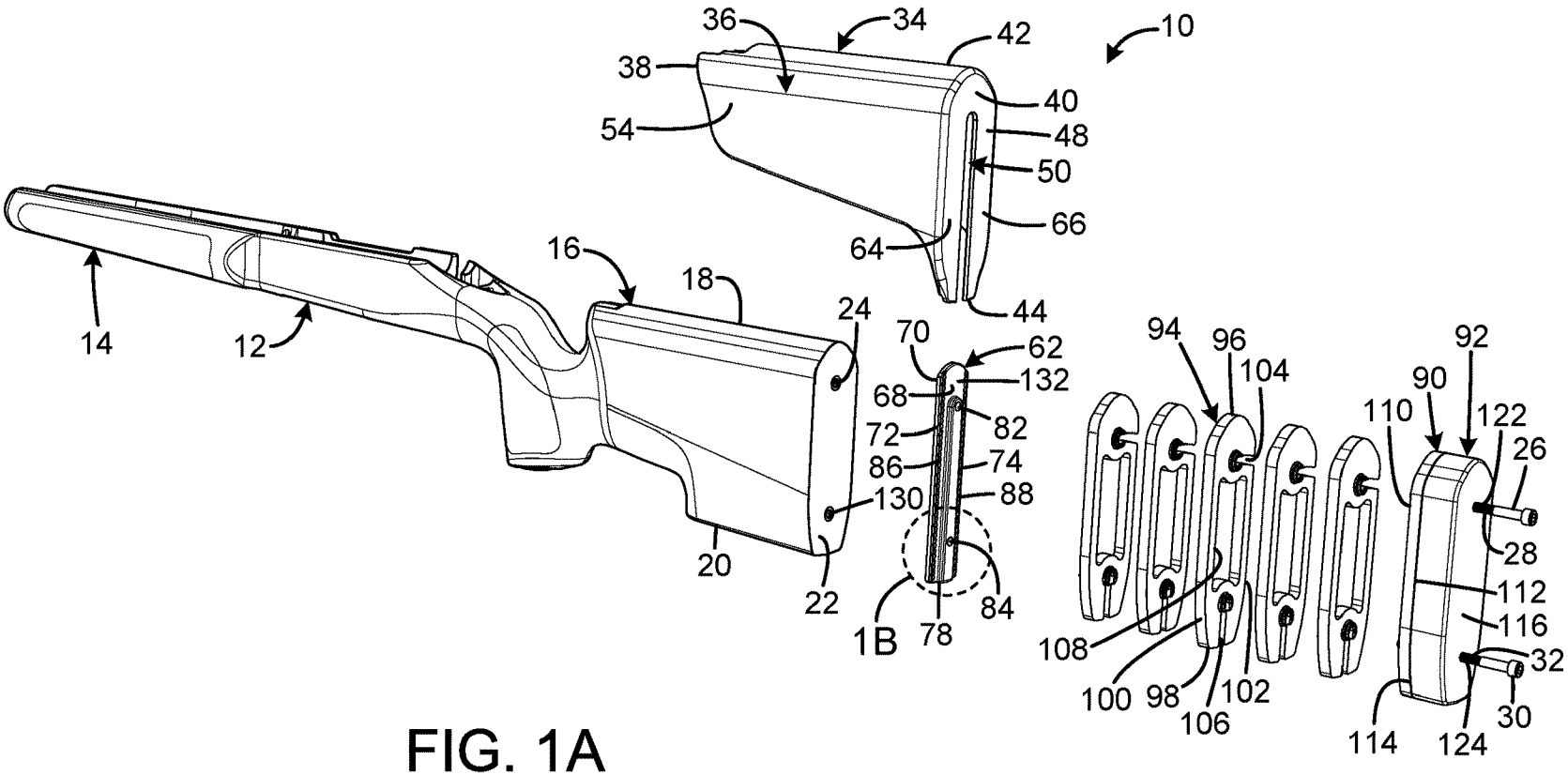
FIG. 1A is a rear exploded view of the current embodiment of the firearm stock with adjustable comb riser constructed in accordance with the principles of the present invention.
Figure 1B:
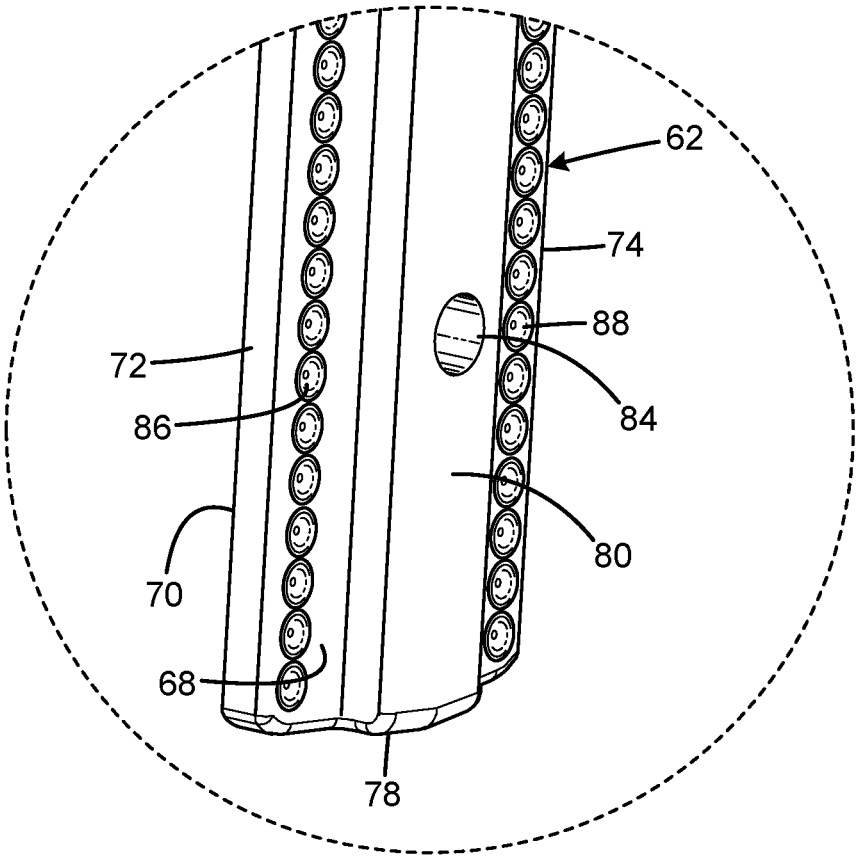
FIG. 1B is an enlarged view of circle 1B of FIG. 1A.
Figure 2A:
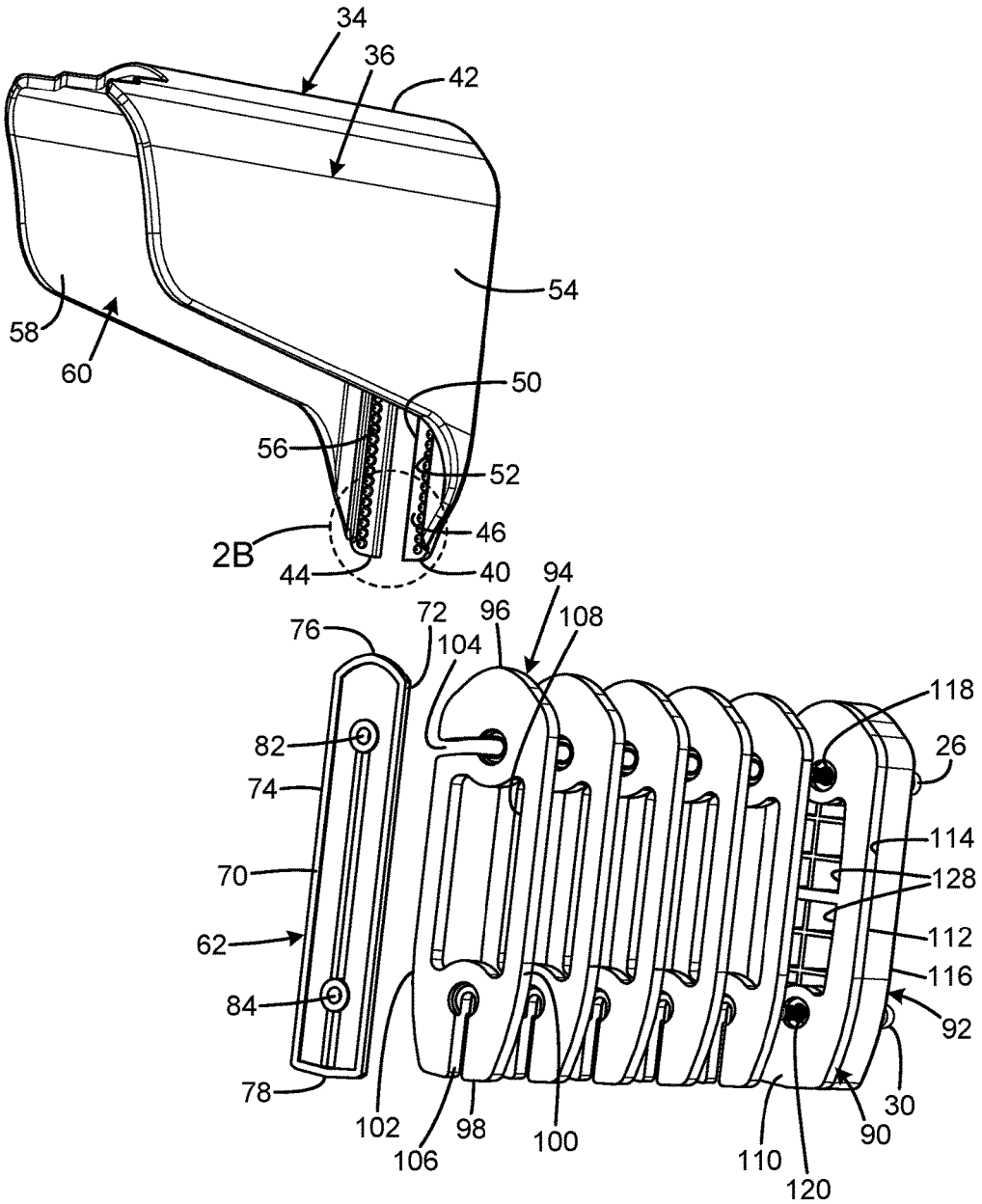
FIG. 2A is a front exploded view of the current embodiment of cheek rest element, ridge plate, spacers, butt plate, and recoil pad of FIG. 1A.
Figure 2B:
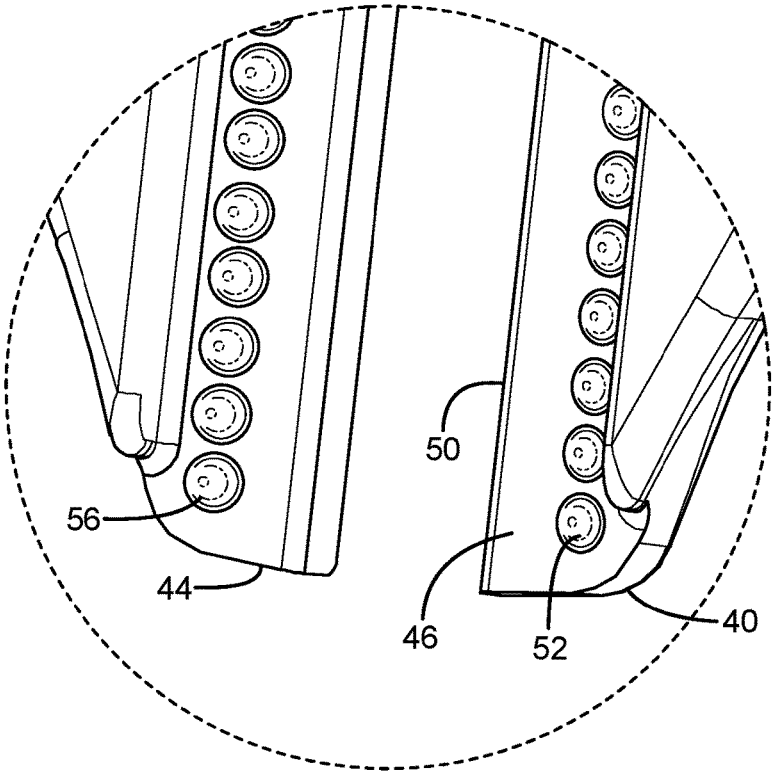
FIG. 2B is an enlarged view of circle 2B of FIG. 2A.

An embodiment of the firearm stock with adjustable comb riser of the present invention is shown and generally designated by the reference numeral 10.

FIGS. 1A-2B illustrate the improved firearm stock with adjustable comb riser 10 of the present invention. More particularly, the firearm stock is an elongated body 12 having a forend 14 and an opposed butt stock portion 16. The butt stock portion has an upper comb surface 18, a bottom 20, and a rear face 22. The rear face defines an upper aperture 24 and a lower aperture 130. An upper screw 26 has a threaded portion 28 threadedly received by upper aperture 24. A lower screw 30 has a threaded portion 32 threadedly received by lower aperture 130. The upper and lower screws are fasteners that connect a butt pad (butt plate 90 with a recoil pad 92) to the rear face of the butt stock portion.

A cheek rest element 34 has an elongated rest portion 36 positioned above the upper comb surface 18 of the butt stock portion 16. The cheek rest element has a front 38, rear wall 40, top 42, and bottom 44. The rear wall has a front surface 46 and a rear surface 48. The rear wall includes opposed left and right panel portions 64, 66 that define a central rear channel 50. The central rear channel has a rounded closed end below the top of the cheek rest element and an opposed open end at the bottom of the cheek rest element. The front surface of the rear wall defines a plurality of left bumps 52 that are spaced apart from the central rear channel and are adjacent to where a left side wall 54 of the elongated rest portion is attached to the front surface of the rear wall. The front surface of the rear wall also defines a plurality of right bumps 56 that are spaced apart from the central rear channel and are adjacent to where a right side wall 58 of the elongated rest portion is attached to the front surface of the rear wall. The elongated rest portion, including the downwardly depending left and right side walls, defines a downwardly open channel 60. The downwardly open channel receives at least a portion of the upper comb surface of the butt stock portion.

A vertical rear panel/ridge plate 62 is received within the downwardly open channel 60 and has a rear surface 68 that abuts the front surface 46 of the rear wall 40 of the cheek rest element 34. The ridge plate also has a front surface 70, left side 72, right side 74, top 76, and bottom 78. The rear surface of the ridge plate includes a central protrusion/ridge 80 that defines an upper aperture 82 and a lower aperture 84. The upper aperture is adapted to receive the upper screw 26, and the lower aperture is adapted to receive the lower screw 30. The rear surface of the ridge plate also defines a plurality of left recesses 86 that are parallel to the left side and are spaced apart from the central protrusion/ridge and a plurality of right recesses 88 that are parallel to the right side and are spaced apart from the central protrusion/ridge. In the current embodiment, the ridge plate is perpendicular to the elongated rest portion 36. An upper portion 132 of the ridge plate located above the central protrusion spans between the left and right side walls 54, 58 of the cheek rest element. The central protrusion/ridge is adapted to be received within the central rear channel 50 of the rear wall of the cheek rest element.

One or more optional spacers 94, up to a maximum of five in the current embodiment, can be interposed between at least one of the rear face 22 of the butt stock portion 16 and the butt plate 90 to adjust the pull length of the stock body 12. Each of the spacers is identical and has a top 96, bottom 98, left side 100, and right side 102. Each of the spacers defines an upper channel 104, lower channel 106, and central aperture 108. In the current embodiment, the upper channel 104 opens towards the right side, and the lower channel 106 opens towards the bottom. The upper channel enables the top of the spacer to receive the upper screw 26 without requiring removal of the upper screw from the ridge plate 62 and butt stock portion. The lower channel enables the bottom of the spacer to receive the lower screw 30 without requiring removal of the lower screw from the ridge plate and butt stock portion. The differing orientations of the upper and lower channels prevent the spacer from falling off the upper and lower screws when the upper and lower screws are loosened to adjust the cheek rest element 34 and/or to add or remove spacers. The central aperture in each spacer is present to reduce their weight. The closed end portions of the upper and lower channels each have a rearward-facing protrusion and a forward-facing recess to ensure proper alignment when multiple spacers are used concurrently by having the rearward-facing protrusions of each spacer nest in the adjacent spacer's forward-facing recesses.

The butt plate 90 has a front 110 and a rear 112. The butt plate defines an upper aperture 118 that receives upper screw 26, a lower aperture 120 that receives lower screw 30, and central apertures 128 to reduce weight. The upper and lower apertures each have a forward-facing recess that receives the rearward-facing protrusions of an adjacent spacer 94 if a spacer is present. The recoil pad 92 has a front 114 attached to the rear of the butt plate and a rear 116 that defines an upper aperture 122 that receives the upper screw and a lower aperture 124 that receives the lower screw. The recoil pad is made of a resilient material to absorb recoil forces.

Figure 3:
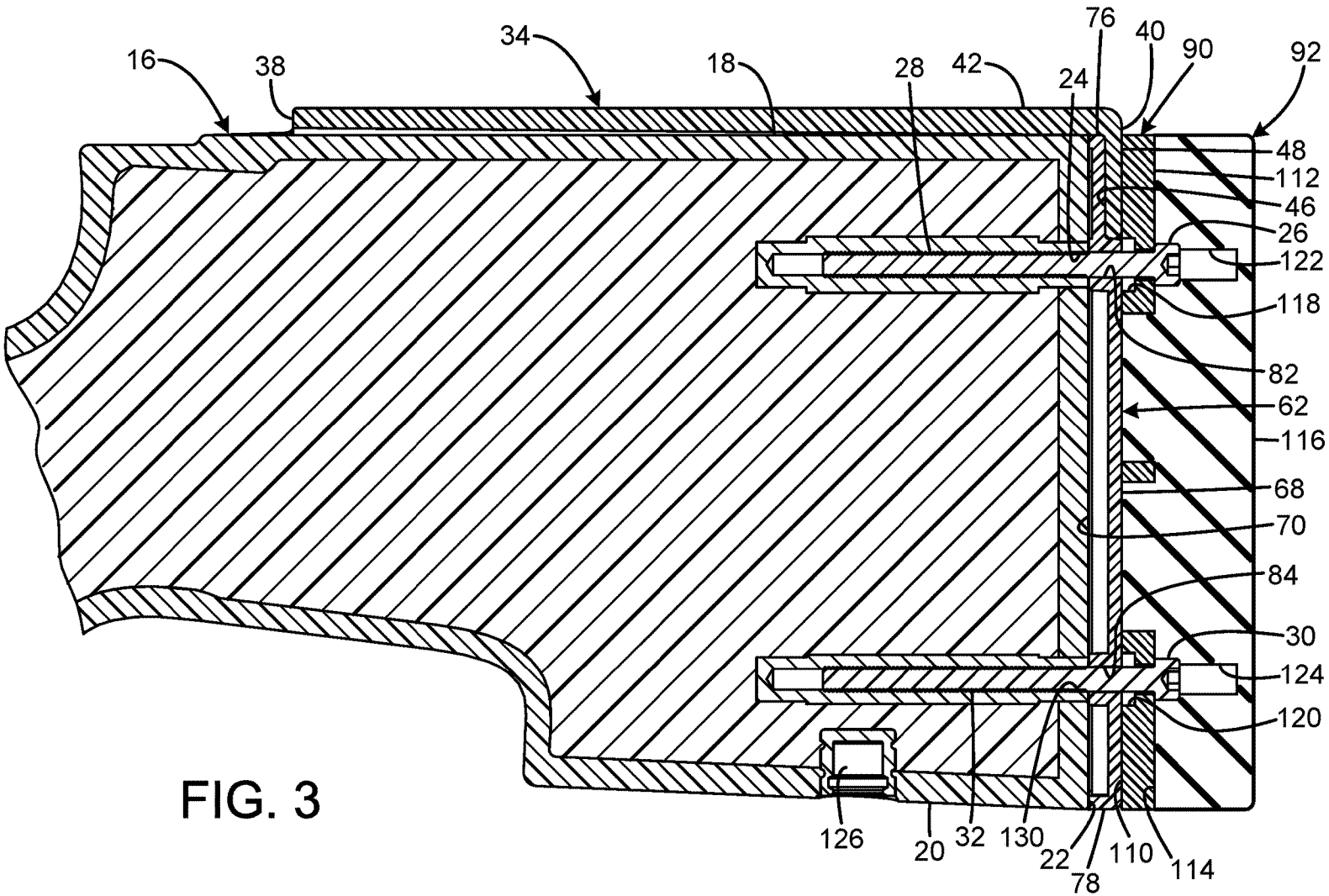
FIG. 3 is a side sectional view of the butt stock of FIG. 1A in a short pull configuration without any spacers.

FIG. 3 illustrates the improved butt stock portion 16 of the present invention. More particularly, the butt stock portion is shown in the short pull configuration with no spacers 94 installed. In the short pull configuration, the front 70 of the ridge plate 62 abuts the rear face 22 of the butt stock. The upper and lower screws 26, 30 clamp the ridge plate and the rear wall 40 of the cheek rest element 34 between the front 110 of the butt plate 90 and the rear face of the butt stock. The bottom 20 of the butt stock portion includes an optional swivel mount 126 for connecting one end of a shoulder strap (not shown) to the butt stock portion. To change the pull configuration, the user loosens the upper and lower screws until the butt plate can be pulled rearward to expose a sufficient portion of the upper and lower screws to add the desired quantity of spacers.

Figure 4:
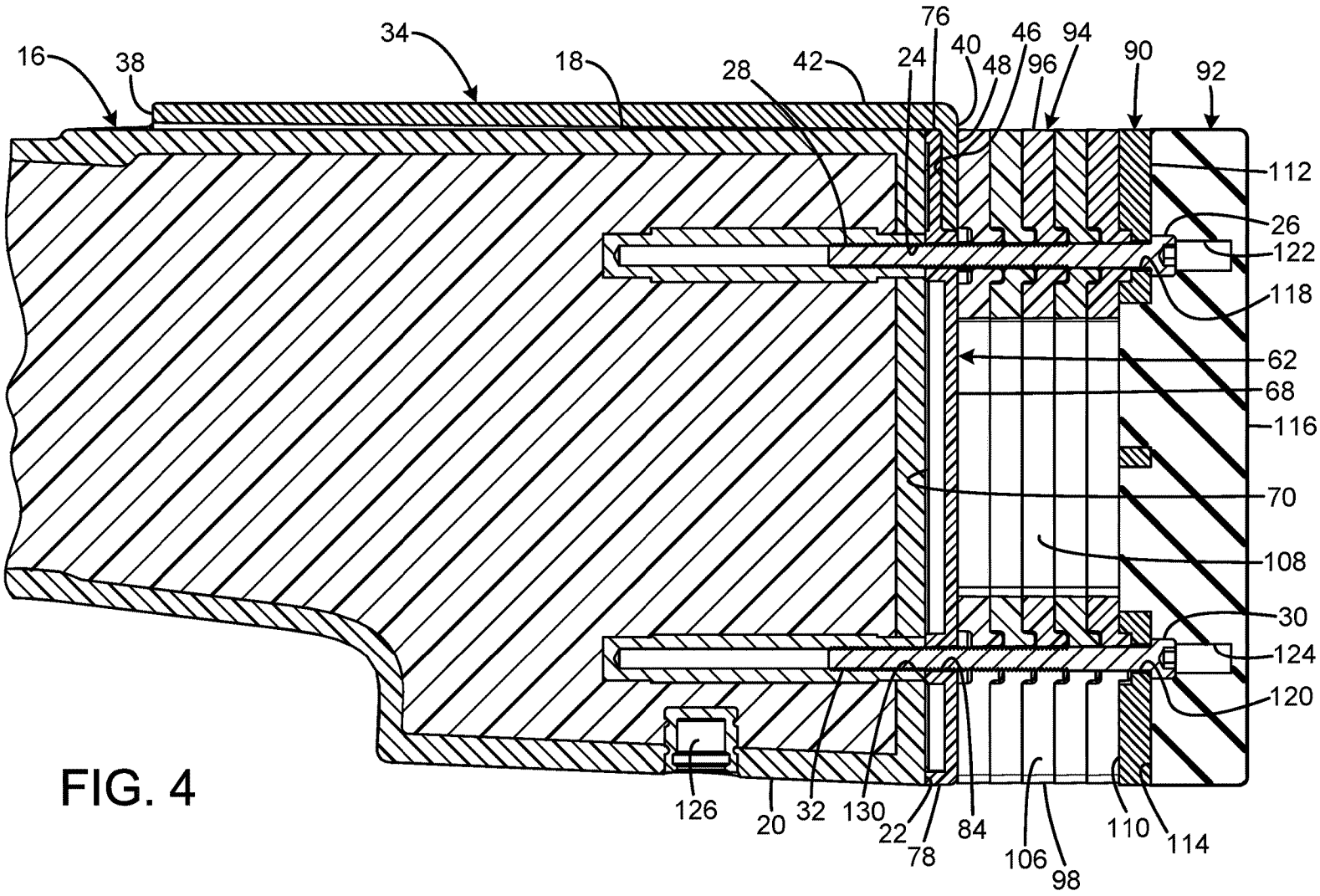
FIG. 4 is a side sectional view of the butt stock of FIG. 1A in a long pull configuration with the spacers located rearward of the comb riser.

FIG. 4 illustrates the improved butt stock portion 16 of the present invention. More particularly, the butt stock portion is shown in one of the two possible long pull configurations, which have the maximum quantity of spacers 94 installed. In the configuration shown in FIG. 4, the front 70 of the ridge plate 62 still abuts the rear face 22 of the butt stock, so the position of the cheek rest element 34 relative to the butt stock portion has not changed relative to FIG. 3. However, the threaded portions 28, 32 of the upper and lower screws 26, 30 have been partially withdrawn from the apertures 24, 130 in the rear face 22 of the butt stock portion relative to FIG. 3. This withdrawal has enabled the butt plate 90 to be pulled rearward to expose a sufficient portion of the upper and lower screws such that all five spacers can be installed. Subsequently, the upper and lower screws are tightened to clamp the spacers, rear wall 40 of the cheek rest element, and the ridge plate 62 between the front 110 of the butt plate and the rear surface of the butt stock. In the current embodiment, the range of pull length adjustment with the maximum quantity of spacers relative to no spacers is 1½ inch.

Figure 5:
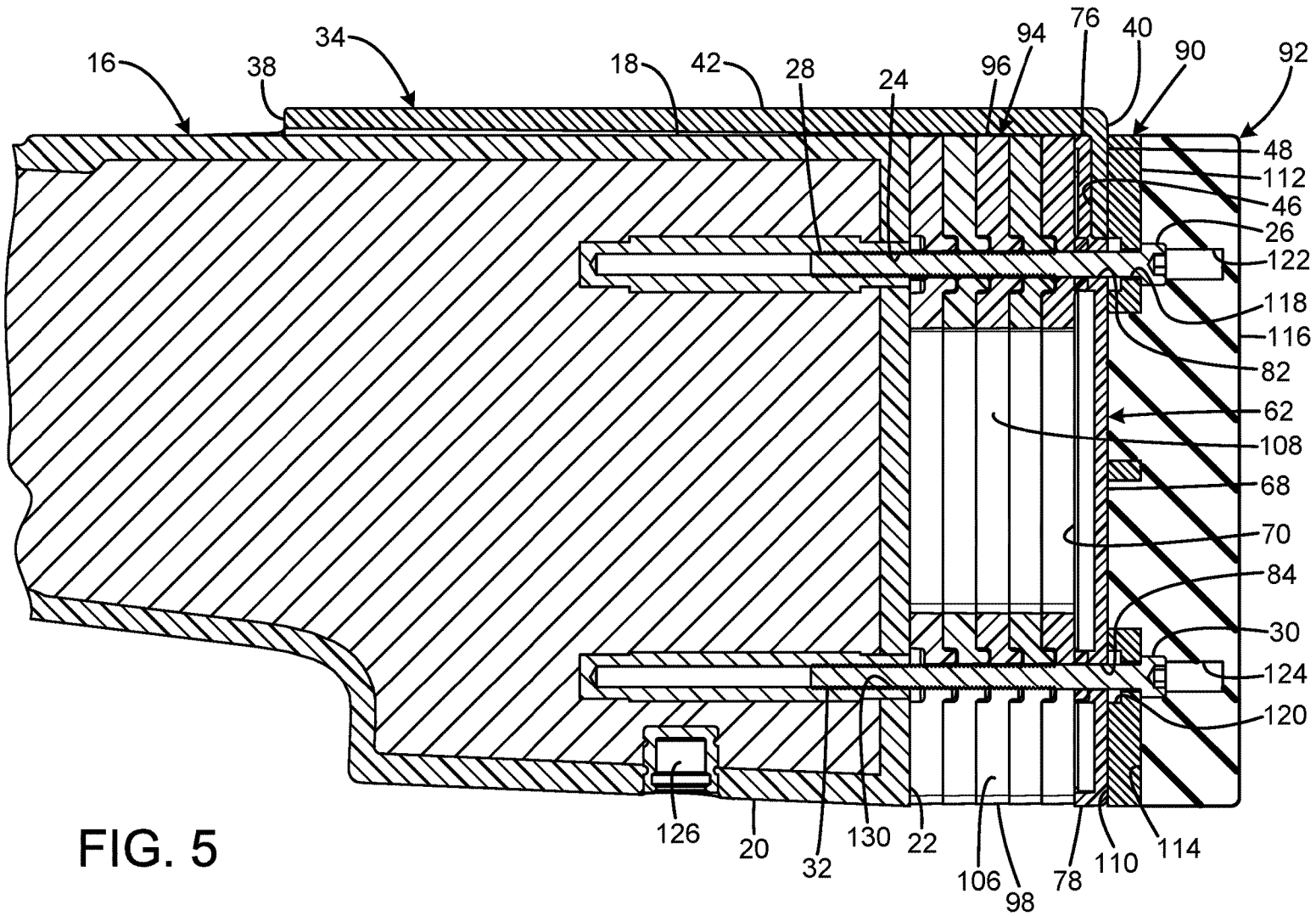
FIG. 5 is a side sectional view of the butt stock of FIG. 1A in a long pull configuration with the spacers located forward of the comb riser.
Figure 6A:
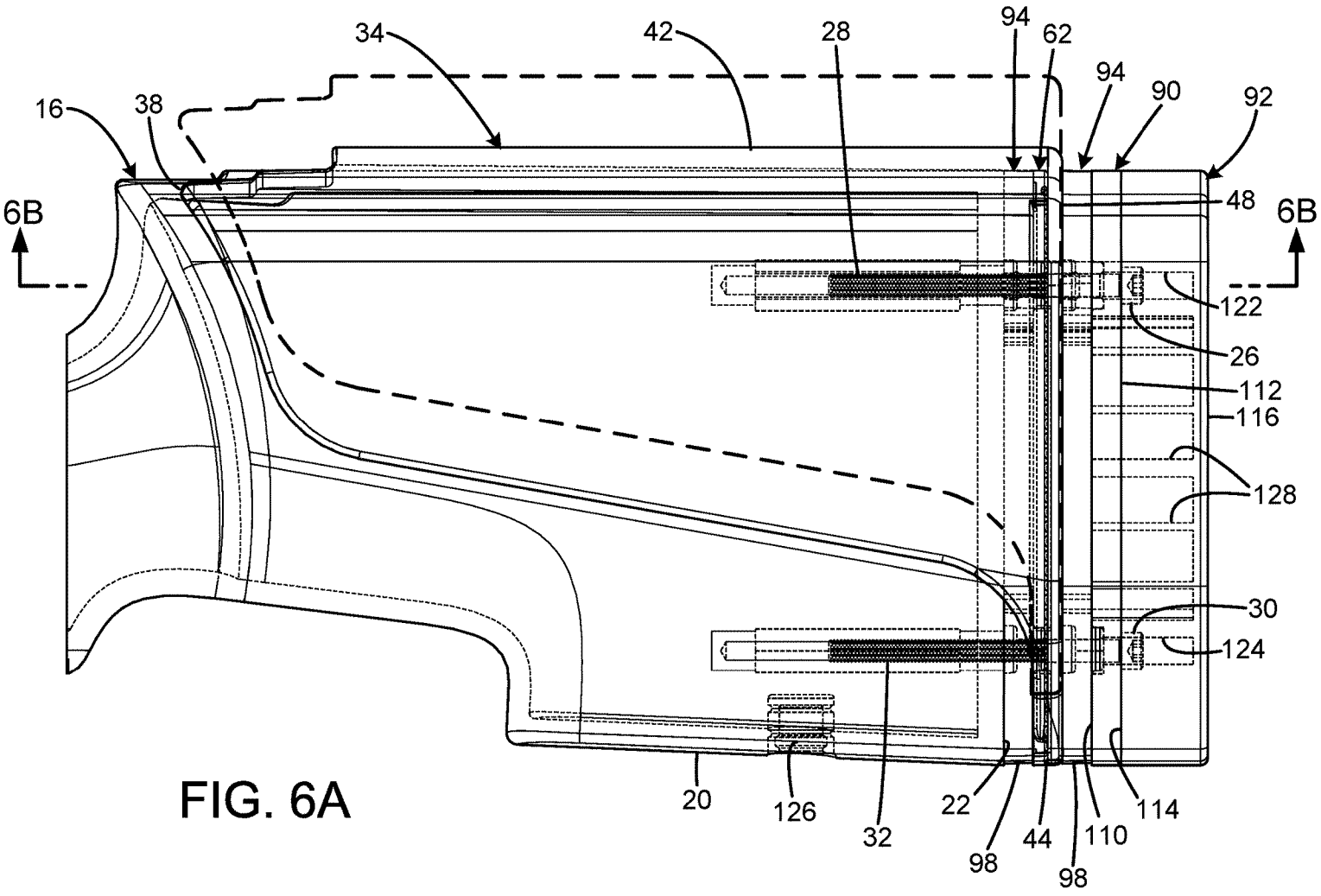
FIG. 6A is a side view of the butt stock of FIG. 1A in an intermediate pull configuration with one spacer in front of the comb riser and one spacer behind the comb riser.
Figure 6B:
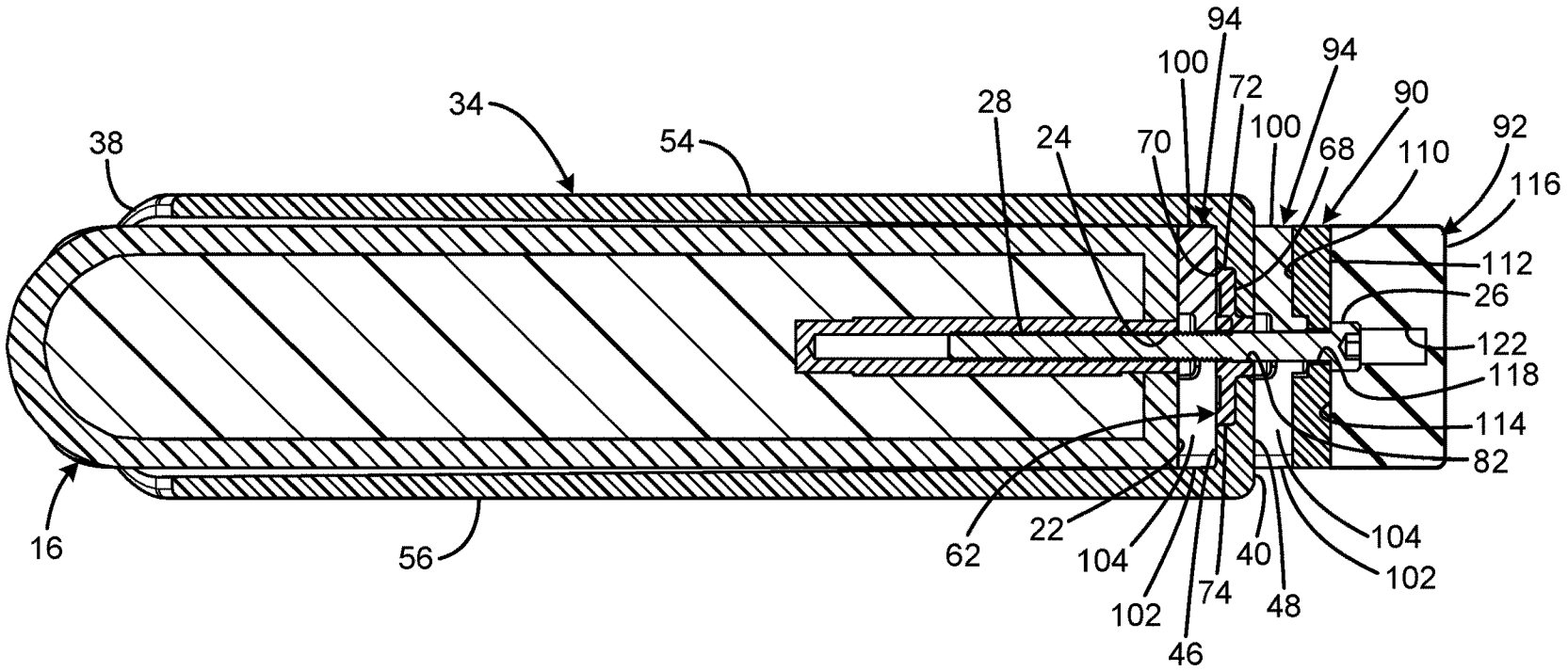
FIG. 6B is a top sectional view taken along lines 6B-6B of FIG. 6A.
Figure 7A:
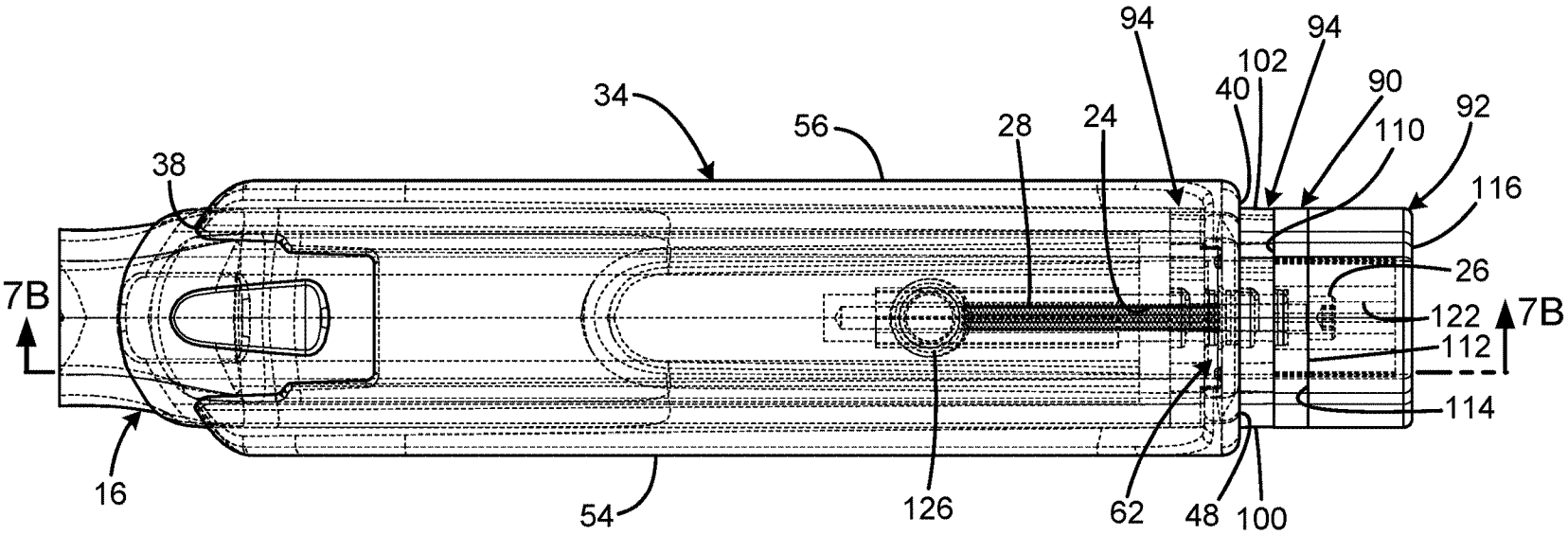
FIG. 7A is a top view of the butt stock of FIG. 1A in an intermediate pull configuration with one spacer in front of the comb riser and one spacer behind the comb riser.
Figure 7B:
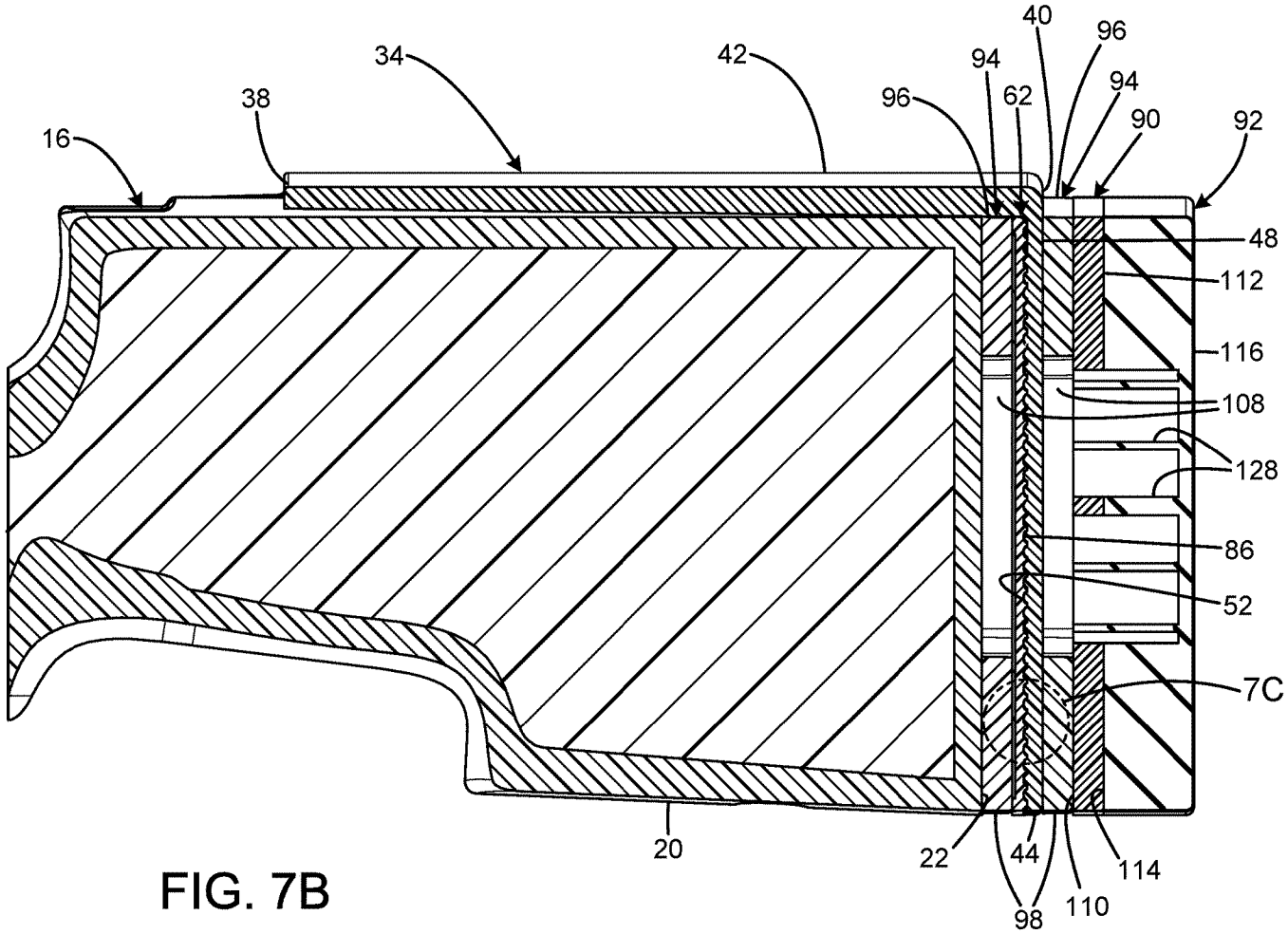
FIG. 7B is a side sectional view taken along lines 7B-7B of FIG. 7A.
Figure 7C:
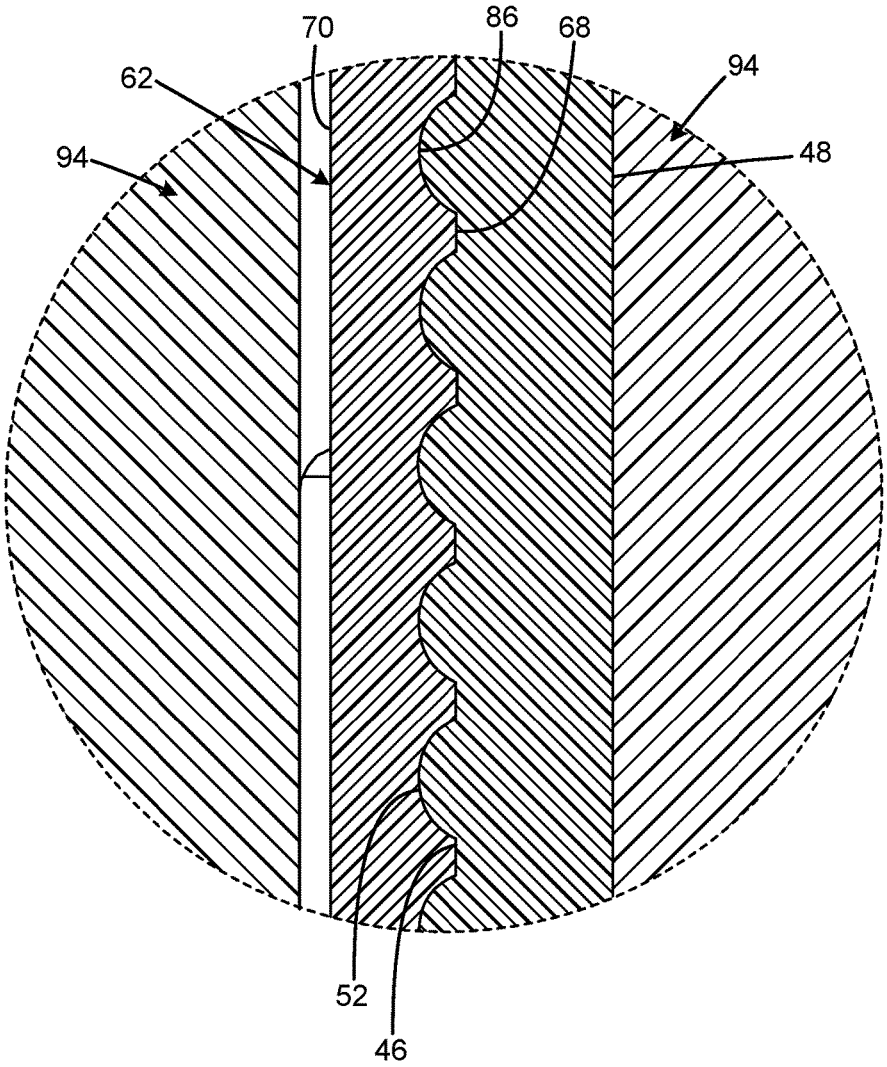
FIG. 7C is an enlarged view of circle 7C of FIG. 7B.

FIG. 5 illustrates the improved butt stock portion 16 of the present invention. More particularly, the butt stock portion is shown in the other of the two possible long pull configurations, which have the maximum quantity of spacers 94 installed. In the configuration shown in FIG. 5, the front 70 of the ridge plate 62 no longer abuts the rear face 22 of the butt stock, so the position of the cheek rest element 34 relative to the butt stock portion has been shifted aft/rearward relative to FIG. 3. The threaded portions 28, 32 of the upper and lower screws 26, 30 have been partially withdrawn from the apertures 24, 130 in the rear face 22 of the butt stock portion relative to FIG. 3. This withdrawal has enabled the butt plate 90, cheek rest element, and ridge plate 62 to be pulled rearward to expose a sufficient portion of the upper and lower screws such that all five spacers can be installed. Subsequently, the upper and lower screws are tightened to clamp the spacers, rear wall 40 of the cheek rest element, and the ridge plate 62 between the front 110 of the butt plate and the rear surface of the butt stock with the forwardmost spacer abutting the rear face of the butt stock.

FIGS. 6A-7C illustrate the improved butt stock portion 16 of the present invention. More particularly, the butt stock portion is shown in an intermediate pull configuration with two spacers 94 installed. In the configuration shown in FIGS. 6A-7C, the front 70 of the ridge plate 62 no longer abuts the rear face 22 of the butt stock, so the position of the cheek rest element 34 relative to the butt stock portion has been shifted aft/rearward relative to FIG. 3, but not as far aft/rearward as the long pull configuration shown in FIG. 5. The threaded portions 28, 32 of the upper and lower screws 26, 30 have been partially withdrawn from the apertures 24, 130 in the rear face 22 of the butt stock portion relative to FIG. 3. This withdrawal has enabled the butt plate 90, cheek rest element, and ridge plate 62 to be pulled rearward to expose a sufficient portion of the upper and lower screws such that two spacers can be installed. In FIGS. 6A-7C, one spacer has been installed between the front 70 of the ridge plate and the rear face of the butt stock portion, and one spacer has been installed between the rear surface 48 of the rear wall 40 of the cheek rest element and the front 110 of the butt plate. Subsequently, the upper and lower screws are tightened to clamp the spacers, rear wall of the cheek rest element, and the ridge plate between the front of the butt plate and the rear surface of the butt stock with the forward-most spacer abutting the rear face of the butt stock. It should be appreciated that the spacers can be interposed in any desired arrangement in front of or behind the rear wall of the cheek rest element to enable a choice of fore and aft positions of the cheek rest element.

It should also be appreciated that the left and right recesses 86, 88 on the rear surface 68 of the ridge plate 62 are arranged so they can receive the left and right bumps 52, 56 on the front surface 46 of the rear wall 40 of the cheek rest element 34 when the ridge plate is installed in the cheek rest element. Interaction between the recesses on the ridge plate and the bumps on the rear wall (shown in FIGS. 7B & C) provides a number of secure vertical attachment levels and avoids creep from recoil forces for the cheek rest element when the ridge plate and rear wall are clamped together by the upper and lower screws 26, 32 between the rear face of the butt stock portion 16 and the front 110 of the butt plate 90. Thus, the front surface of the ridge plate and the rear surface of the rear wall are opposed front and rear surfaces adapted to contact the stock body 12 and butt plate in a range of vertical positions to provide a selected height of the cheek rest element. The maximum range of vertical adjustment is denoted by the dashed lines in FIG. 6A. In the current embodiment, the cheek rest element's range of vertical adjustment relative to the upper comb surface of the butt stock portion is 1 inch. Furthermore, the height adjustment capability of the cheek rest element is independent of the pull length adjustment capability, such that the cheek rest element can be adjusted to any of the available vertical positions regardless of the quantity and location of any installed spacers 94.

In the current embodiment, the exterior of the firearm stock with adjustable comb riser is made of multiple layers of eight-ounce woven fiberglass cloth, laminated under pressure with epoxy resin. Both the forend and the butt stock portion have foam inserts. The forend foam insert is made of MPC-F95 manufactured by Mearthane Products Corporation of Cranston, R.I., and the butt stock portion foam insert is made of a low density polyurethane foam manufactured by Duna-USA of Ludington, Mich. The threaded inserts in both the forend foam insert and the butt stock portion foam insert are made of 7075 aluminum. The upper and lower screws are both 10-32×2.50 socket head cap screws, but can also be longer or shorter to accommodate additional or fewer spacers than the maximum of five in the current embodiment. The stock body badge located beneath the pistol grip portion of the stock, the ridge plate, and the spacers are made of Zytel® 70G33L BK031 manufactured by DuPont of Wilmington, Del. The forend grip panels, the pistol grip panels, and the cheek rest element are made of X LFT UR-40LGF/000 23159 TAN NA manufactured by Polyone Corporation of Avon Lake, Ohio. The left and right bumps on the rear wall of the cheek rest element have a center-to-center spacing of 0.125 inch, a diameter of 0.100 inch, and a height of 0.031 inch. The left and right bumps on the rear wall of the cheek rest element have adjacent bumps separated by a small 0.025 inch flat region. The left and right bumps on the rear wall of the cheek rest element are arranged in two columns that are each positioned 0.285 inch from the vertical centerline of central rear channel. The left and right recesses on the ridge plate have flat bottoms and curved sidewalls with a center-to-center spacing of 0.125 inch, a diameter of 0.102 inch, and depth of 0.030 inch. The left and right recesses on the ridge plate have adjacent recesses tangentially abutting each other. The left and right recesses on the ridge plate are arranged in two columns that are each positioned 0.2855 inch from the vertical centerline of the ridge plate.

In the context of the specification, the terms "rear" and "rearward," and "front" and "forward" have the following definitions: "rear" or "rearward" means in the direction away from the muzzle of the firearm while "front" or "forward" means it is in the direction towards the muzzle of the firearm.

While a current embodiment of a firearm stock with adjustable comb riser has been described in detail, it should be apparent that modifications and variations thereto are possible, all of which fall within the true spirit and scope of the invention. For example, it should be appreciated that many or all the features of the discrete rear panel/ridge plate could be incorporated into the rear face of the butt stock and/or the rear wall of the cheek rest element to eliminate the need for a separate rear panel/ridge plate. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A rifle stock comprising:

an elongated stock body having a forend and an opposed butt portion having a rear face and an upper comb surface; a butt pad removably connected to the rear face;

a cheek rest element having an elongated rest portion positioned above the upper comb surface of the stock;

the cheek rest element having a rear panel connected to the rest portion;

at least a portion of the rear panel being captured between the rear face and the butt pad;

at least a portion of the rear panel being captured between the rear face and the butt pad; and a fastener adapted to generate compressive clamping force between the butt pad and the stock to secure the cheek rest.

2. The rifle stock of claim 1 wherein the rest portion is a downwardly open channel.

3. The rifle stock of claim 2 wherein the channel receives at least a portion of the comb surface.

4. The rifle stock of claim 1 wherein the rest portion includes downwardly depending sidewalls.

5. The rifle stock of claim 4 wherein an upper portion of the rear panel spans between the sidewalls.

6. The rifle stock of claim 1 wherein the rear panel is perpendicular to the rest portion.

7. The rifle stock of claim 1 wherein the rear panel has opposed panel portions defining a channel adapted to receive a fastener connecting the butt pad to the stock body.

8. The rifle stock of claim 7 wherein the rear face of the stock body includes a protrusion adapted to be received within the channel.

9. The rifle stock of claim 1 wherein the rear panel has opposed front and rear surfaces adapted to contact the stock body and butt pad in a range of vertical positions to provide a selected height of the cheek rest element.

10. The rifle stock of claim 1 including a spacer adapted to be interposed between the rear panel and at least one of the rear face and the butt pad.

11. The rifle stock of claim 10 wherein the rear panel is adapted to be positioned forward and aft of the spacer, such that a choice of fore and aft positions of the cheek rest element is enabled.

12. The rifle stock of claim 1 including a plurality of spacers adapted to be interposed between the rear face and the butt pad, and wherein the rear panel is adapted to be positioned at any selected position with respect to any of the spacers, such that a choice of fore and aft positions of the cheek rest element is enabled.

13. The rifle stock of claim 1 including a fastener adapted to generate compressive clamping force between the butt pad.

14. The rifle stock of claim 1 wherein the rest portion includes downwardly depending sidewalls.

15. The rifle stock of claim 4 wherein an upper portion of the rear panel spans between the sidewalls.

16. The rifle stock of claim 1 wherein the rear panel is perpendicular to the rest portion.

17. The rifle stock of claim 1 wherein the rear panel has opposed panel portions defining a channel adapted to receive a fastener connecting the butt pad to the stock body.

18. The rifle stock of claim 7 wherein the rear face of the stock body includes a protrusion adapted to be received within the channel.

19. The rifle stock of claim 1 wherein the rear panel has opposed front and rear surfaces adapted to contact the stock body and butt pad in a range of vertical positions to provide a selected height of the cheek rest element.

20. A rifle stock comprising:

an elongated stock body having a forend and an opposed butt portion having a rear face and an upper comb surface;

a butt pad removably connected to the rear face;

a cheek rest element having an elongated rest portion positioned above the upper comb surface of the stock;

the cheek rest element having a rear panel connected to the rest portion;

at least a portion of the rear panel being captured between the rear face and the butt pad; and a fastener connected to the butt pad and to the stock and adapted to generate compressive clamping force between the butt pad and the stock to secure the cheek rest.

* * * * *